US007946267B2

(12) United States Patent
Taira

(10) Patent No.: US 7,946,267 B2
(45) Date of Patent: May 24, 2011

(54) INTAKE DEVICE OF INTERNAL COMBUSTION ENGINE

(75) Inventor: Takahiro Taira, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 275 days.

(21) Appl. No.: 12/174,188

(22) Filed: Jul. 16, 2008

(65) Prior Publication Data

US 2009/0020095 A1 Jan. 22, 2009

(30) Foreign Application Priority Data

Jul. 17, 2007 (JP) ..... 2007-186040

(51) Int. Cl.
*F02M 35/10* (2006.01)

(52) U.S. Cl. ..... 123/184.42

(58) Field of Classification Search ..... 123/184.34, 123/184.35, 184.42, 184.43, 184.47, 184.48, 123/184.51, 184.53, 184.57, 184.21
See application file for complete search history.

(56) References Cited

U.S. PATENT DOCUMENTS 4,715,348 A * 12/1987 Kobayashi et al. ..... 73/114.74
2006/0249115 A1* 11/2006 Hashimoto et al. ..... 123/184.55

FOREIGN PATENT DOCUMENTS

JP 11 141417 A 5/1999
JP 2000 320413 A 11/2000
JP 2003 254179 A 9/2003
JP 2004-124831 A 4/2004
JP 2005 048736 A 2/2005
JP 2007-40142 A 2/2007

* cited by examiner

*Primary Examiner* — Michael Cuff
*Assistant Examiner* — Keith Coleman
(74) *Attorney, Agent, or Firm* — Arent Fox LLP

(57) ABSTRACT

An intake passage is formed by connecting an upper case 10 and a lower case 20 of an intake manifold. The lower case 10 has a recessed portion 50 on part of an inner surface 17*a* of a side wall 17. The recessed portion 50 has a deep surface 53 to which a negative pressure outlet port 42 opens, and an opening 51 opened upwards is provided in an upper portion of the recessed portion 50 in a position which opposes to the upper case 20 in a vertical direction A0. The upper case 20 has a projecting portion 60 which extends further downwards towards the negative pressure outlet port 42 than mating surfaces 10*a*, 20*a* and projects into the recessed portion 50 through an opening 52. The projecting portion 60 is positioned between the negative pressure outlet port 42 and the inner surface 17*a* in a horizontal direction A1.

3 Claims, 4 Drawing Sheets

INTAKE DEVICE OF INTERNAL COMBUSTION ENGINE

CROSS-REFERENCE TO RELATED APPLICATION

This application claims the priority of JP Application No. 2007-186040, filed Jul. 17, 2007, the entire specification, claims and drawings of which are incorporated herewith by reference.

BACKGROUND OF THE INVENTION

1. Field of the Invention

The present invention relates to an intake device provided in an internal combustion engine and more particularly to a waterproof construction provided in an intake device which is provided with a negative pressure outlet port for taking out negative pressure generated in an intake passage for preventing water from entering into the negative pressure outlet port.

2. Description of Related Art

In an intake device of an internal combustion engine, sometimes moisture which is present in air which flows through an intake passage formed by passage walls adheres to inner surfaces of the passage walls in the form of water drops. In this case, the water drops may flow along the inner surfaces to enter into a negative pressure passage from a negative pressure outlet port which opens to the intake passage and become frozen due to a reduction in atmospheric temperature when the internal combustion engine is stopped. Thus, a negative pressure is prevented from being take out from the negative pressure outlet port immediately after the internal combustion engine is started to operate. To address these problems, there are known various waterproof constructions for suppressing the entering of water drops into the negative pressure outlet port. For example, refer to Japanese Unexamined Patent Publications JP-A-2007-40142 and JP-A-2004-124831.

In a waterproof construction in which inner surfaces of passage walls which form an intake passage extend in a vertical direction and a negative pressure outlet port opens to a projecting portion which is provided on the inner surface so as to project into the intake passage, water drops which flow downwards along the inner surface is guided so as not to reach the negative pressure outlet port by a rising surface of the projecting portion. However, since the projecting portion which projects into the intake passage hinders the flow of intake air, the passage resistance of the intake passage is increased and intake efficiency is lowered.

In addition, in a waterproof construction in which a recessed portion is provided on an inner surface of passage walls, although the increase in passage resistance of the intake passage is suppressed compared with the waterproof construction in which the projecting portion is provided, a projecting portion (for example, a baffle plate) which projects towards an opening formed in the recessed portion so as to prevent the entering of water drops into a negative pressure outlet port needs to be provided within the recessed portion so as to surround the negative pressure outlet port. Accordingly, the recessed portion is enlarged, and the disposition of the negative pressure outlet port in the intake device becomes restricted. In addition, the construction of the recessed portion becomes complex and the production costs of the intake device increases.

SUMMARY OF THE INVENTION

The invention has been made in view of these situations. In a waterproof construction for suppressing the entering of water drops into a negative pressure outlet port in an intake device, wherein the water proof construction is made up of a recessed portion and a projecting portion which are provided on passage walls which form an intake passage, the present invention aims to suppress the increase in passage resistance of the intake passage and to reduce the production costs. In addition, the present invention also aims, to increase further the effect of preventing the entering of water drops into the negative pressure outlet port by the waterproof construction.

According to a first aspect of the invention there is provided an intake device of an internal combustion engine, including:

an upper passage wall and a lower passage wall which are disposed next to each other in a vertical direction and are connected together to form an intake passage, wherein the lower passage wall has a recessed portion, which is recessed in a horizontal direction, in part of an inner surface thereof, in a deep portion in the horizontal direction, the recessed portion has a recessed surface to which a negative pressure outlet port for taking out negative pressure generated in the intake passage opens, an opening which opens upwards is provided in a position which opposes to the upper passage wall in the vertical direction at an upper portion of the recessed portion, the upper passage wall has a projecting portion which extends downwards towards the negative pressure outlet port and which projects into the recessed portion through the opening and the projecting portion is positioned between the negative pressure outlet port and the inner surface in the horizontal direction.

According to a second aspect of the invention, there is provided the intake device of the internal combustion engine as set forth in the first aspect of the invention, wherein the recessed surface has a deep surface which opposes to the projecting portion in the horizontal direction, the negative pressure outlet port opens at the deep surface and a gap is provided in a horizontal direction between the deep surface and the projecting portion.

According to a third aspect of the invention, there is provided an intake device of the internal combustion engine as set forth in the first aspect of the invention, wherein a lower end portion of the projecting portion is situated above the vicinity of the negative pressure outlet port and has a shape following an upper contour of the negative pressure outlet port.

According to the invention, water drops falling along the inner surface of the upper passage wall towards the negative pressure outlet port flow downwards along the projecting portion which is situated closer to the intake passage side than the negative pressure outlet port and fall from the lower end portion of the projecting portion towards therebelow. Therefore, water drops are restrained from entering into the negative pressure outlet port which lies deeper than the projecting portion within the recessed portion. Accordingly, the reduction in performance of the function of taking out negative pressure is prevented which would otherwise be caused by water drops which have entered from the negative pressure outlet port and become frozen.

Further, the projecting portion is accommodated within the recessed portion and does not project into the intake passage from the inner surface. Therefore, the increase in passage resistance in the intake passage by the water proof construction made up of the recessed portion and the projecting portion is suppressed, and the intake efficiency is increased by such an extent that the increase in passage resistance is so suppressed.

Furthermore, the waterproof construction is formed by connecting the lower passage wall having the recessed portion in which the negative pressure outlet port and the upwardly opened opening are provided with the upper passage wall having the projecting portion which extends downwards; and accommodating the projecting portion in such a state that it projects from the opening into the recessed portion. Therefore, since the lower passage wall and the upper passage wall which have the recessed portion and the projecting portion, respectively are separate members the respective constructions of the recessed portion and the projecting portion are simplified and the respective members are able to be more easily molded. Therefore, the production costs of the intake device can be reduced.

Furthermore, the projecting portion which is situated within the recessed portion is positioned between the inner surface and the negative pressure outlet port in the horizontal direction which is the direction in which the recessed portion is recessed relative to the inner surface of the lower passage wall and the projecting portion is not required to surround the negative pressure outlet port. Therefore, the recessed portion is made smaller in size. Thus, the degree of freedom in disposing the negative pressure outlet port is increased and the lower passage wall can be made smaller in size and lighter in weight.

According to another invention, water drops falling along the projecting portion are prevented from continuing to fall from the lower end portion of the projecting portion to the deep surface to which the negative pressure outlet port opens by the gap defined in the horizontal direction between the projecting portion and the deep surface. Therefore, the suppression of entering of water drops into the negative pressure outlet port can be suppressed further, thereby increasing the effect of preventing the entering of water drops into the negative pressure outlet port by the waterproof construction.

According to another invention, the projecting portion situated within the recessed portion extends as far as above the vicinity of the negative pressure outlet port to cover the recessed portion. Therefore, the range of the recessed portion which is covered by the projecting portion above the negative pressure outlet port is increased. Accordingly, the turbulent flow of intake air caused by the recessed portion is suppressed, and the increase in passage resistance in the intake passage is suppressed further. Moreover, the adhesion of water drops to the recessed surface including the deep surface above the negative pressure outlet port is suppressed further, thereby increasing the effect of preventing the entering of water drops into the negative pressure outlet port.

DETAILED DESCRIPTION OF THE PREFERRED EMBODIMENTS

Figure 1A:
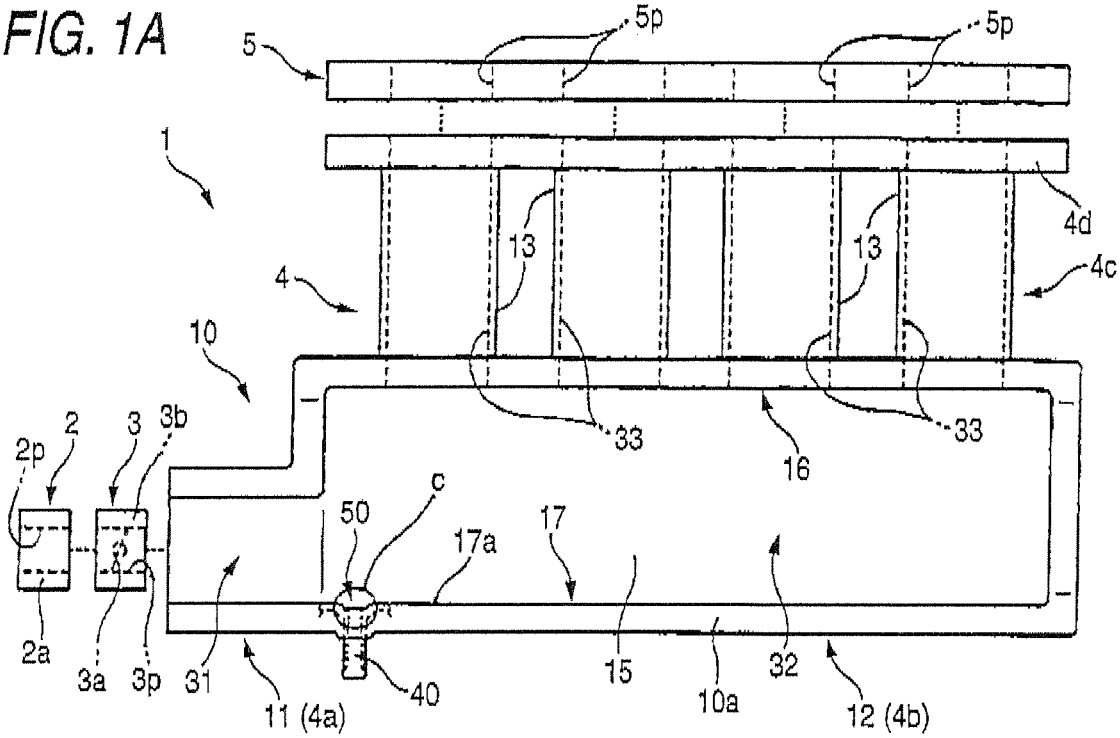
FIG. 1A is a view resulting when a lower case of the intake manifold of an intake device of a first embodiment of the invention is seen from a mating surface of a lower case.
Figure 1B:
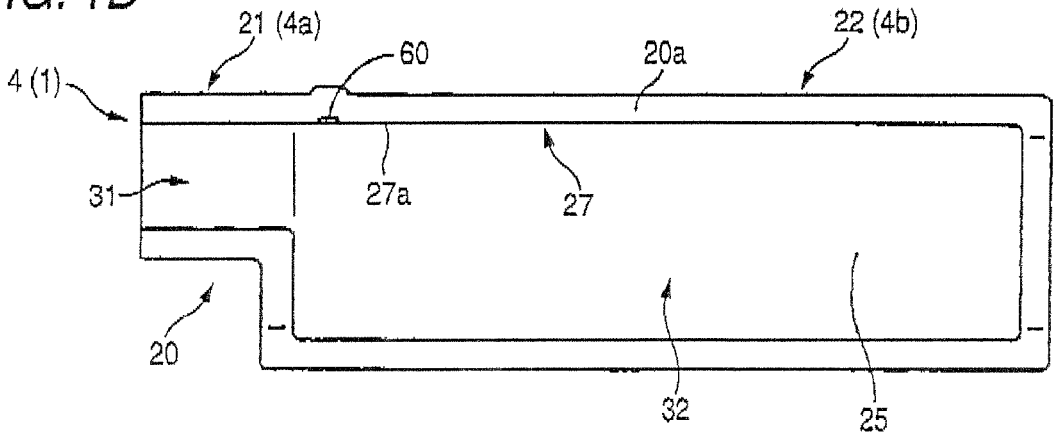
FIG. 1B is a view resulting when an upper case of the intake manifold of FIG. 1A is seen from a mating surface.

Hereinafter, embodiments of the invention will be described by reference to FIGS. 1A to 5.

FIGS. 1A to 3B are drawings describing a first embodiment.

Referring to FIG. 1, an intake device 1 of the present invention is provided in a single-cylinder or multi-cylinder internal combustion engine mounted on a vehicle, or in this embodiment, an inline four-cylinder spark ignition type internal combustion engine.

The intake device includes an air cleaner 2 for cleaning air induced thereinto, a throttle device 3 including a throttle valve 3*a* for controlling flow rate of intake air including the air from the air cleaner 2, and an intake pipe for guiding intake air that has flowed through the throttle device 3 to respective combustion chambers. The intake pipe is made up of an intake manifold 4 which is connected to a downstream of the throttle device 3 and a downstream side intake pipe 5 which is connected to the intake manifold 4. Note that the terms of upstream and downstream are used in relation to the flow of intake air.

In addition, the intake air that has flowed through an intake passage formed by the intake device 1 (hereinafter, referred to simply as an "intake passage") is sucked into the respective combustion chambers through intake ports provided in a cylinder head of the internal combustion engine. In addition, the throttle valve 3*a* controls the flow rate of intake air flowing through the intake passage downstream of the throttle valve 3*a* in accordance with its opening. By the air that is to be sucked into cylinders being reduced by the throttle valve 3*a*, a negative pressure is generated at downstream side of the throttle valve 3*a*.

The intake manifold 4 includes an inlet port 4*a* which forms an inlet passage 31 into which intake air from the throttle device 3 is allowed to flow, a merged portion 4*b* which forms a merged passage 32 into which intake air from the inlet passage 31 is allowed to flow, and a branch portion 4*c* which forms branch passages 33 which branch from the merged passage 32 for guiding intake air individually to the respective combustion chambers.

The downstream side intake pipe 5 which forms a plurality of downstream side branch passages 5*p* which communicate with the corresponding branch passages 33 is connected to a flange portion 4*d* which constitutes a downstream end portion of the branch portion 4*c*. A downstream end of the downstream side intake pipe 5 is connected to the cylinder head.

Depending upon types of internal combustion engines, the flange portion 4*d* may be connected directly to the cylinder head without being connected thereto by the downstream side intake pipe 5.

The merged passage way 32 is an enlarged chamber whose passage area is larger than those of the inlet passage 31 and the respective branch passages 33.

The intake passage is made up of an air chamber 2*p* formed by an air cleaner casing 2*a* of the air cleaner 2, an in-throttle body intake passage 3*p* which is formed by a throttle body 3*b* which is a body of the throttle device 3 and in which the throttle valve 3*a* is disposed, the inlet passage 31, the merged passage 32 and the respective branch passages 33 which are formed by the intake manifold 4 and the respective downstream side branch passages 5*p*.

Here, the intake passage includes passage components including the air cleaner 2, the throttle device 3, the intake manifold 4 and the downstream side intake pipe 5. In addition, respective inner surfaces of the air cleaner casing 2*a*, the throttle body 3*b*, the intake manifold 4 and the downstream side intake pipe 5 constitutes a passage wall surface.

Referring to FIGS. 1A, 1B, 2, 3A and 3B, the intake manifold 4 is a passage component having a separate element assembling construction which is formed by connecting together a plurality of passage walls including at least an upper passage wall and a lower passage wall which are disposed next to each other in a vertical direction A0. In this embodiment, the intake manifold 4 includes a lower case 10 functioning as the lower passage wall and an upper case 20 functioning as the upper passage wall which is disposed above the lower case, and both the cases 10, 20 are configured so as to be connected to each other such that the connection is air tight at mating surfaces 10*a*, 20*a*. Here, next to each other in the vertical direction A0 means above and below in the vertical direction A0.

The lower case 10 and the upper case 20 are each a single member which is molded integrally from a synthetic resin by using a molding die. Edge portions 10*h*, 20*b* thereof which have the mating surfaces 10*a*, 20*a*, respectively, are connected directly to each other by thermal welding as a fastening means.

In addition, the lower case 10 and the upper case 20 may be connected to each other indirectly by bolts as a fastening means via a member separate from both the cases 10, 20 such as a seal member. In addition, the intake manifold 4 may be formed from materials other than resin such as metal and the like.

The lower case 10 includes a lower inlet portion 11 which is part of the inlet portion 4*a*, a lower merged portion 12 which is part of the merged portion 4*b* and branch pipes 13 which are connected to the lower merged portion 12. The lower merged portion 12 has a bottom wall 15 and a lower side wall which surrounds the bottom wall 15 and has an edge portion 10*b*. The lower side wall has a side wall 16 to which the branch passages 33 open and a side wall 17 having an inner surface 17*a* which opposes to the side wall 16 across the merged passage 32.

The upper case 20 includes an upper inlet portion 21 which is part of the inlet portion 4*a* and is connected with the lower inlet portion 11 to make up the inlet port 4*a* and an upper merged portion 22 which is part of the merged portion 4*b* and is connected with the lower merged portion 12 to make up the merged portion 4*b*. The upper merged portion 22 has a ceiling wall 25 and an upper side wall which surrounds the ceiling wall 25 and has an edge portion 20*b*. The upper side wall has a side wall 27 which is connected to the side wall 17 and which has an inner surface 27*a* extending in the vertical direction A0.

Here, the surface extends in the vertical direction A0 means that the surface extends over different positions in the vertical direction A0 so that water drops adhering to the surface flow downwards irrespective of the fact that the surface is a planar or curved surface or the fact that the surface is parallel to the vertical direction A0 or inclined relative to the vertical direction A0.

Figure 1C:
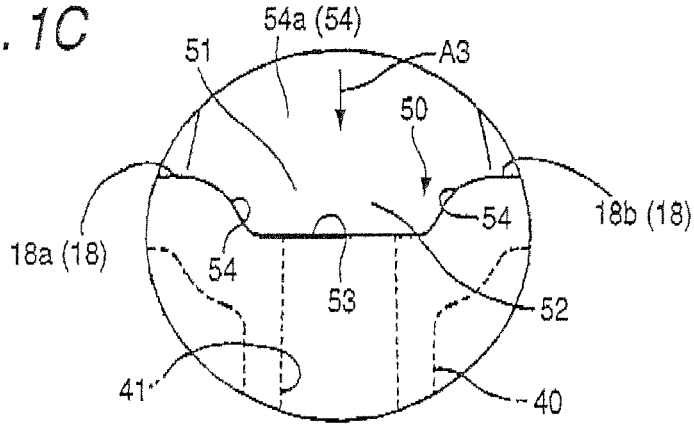
FIG. 1C is an enlarged view of a portion c in FIG. 1A.
Figure 2:
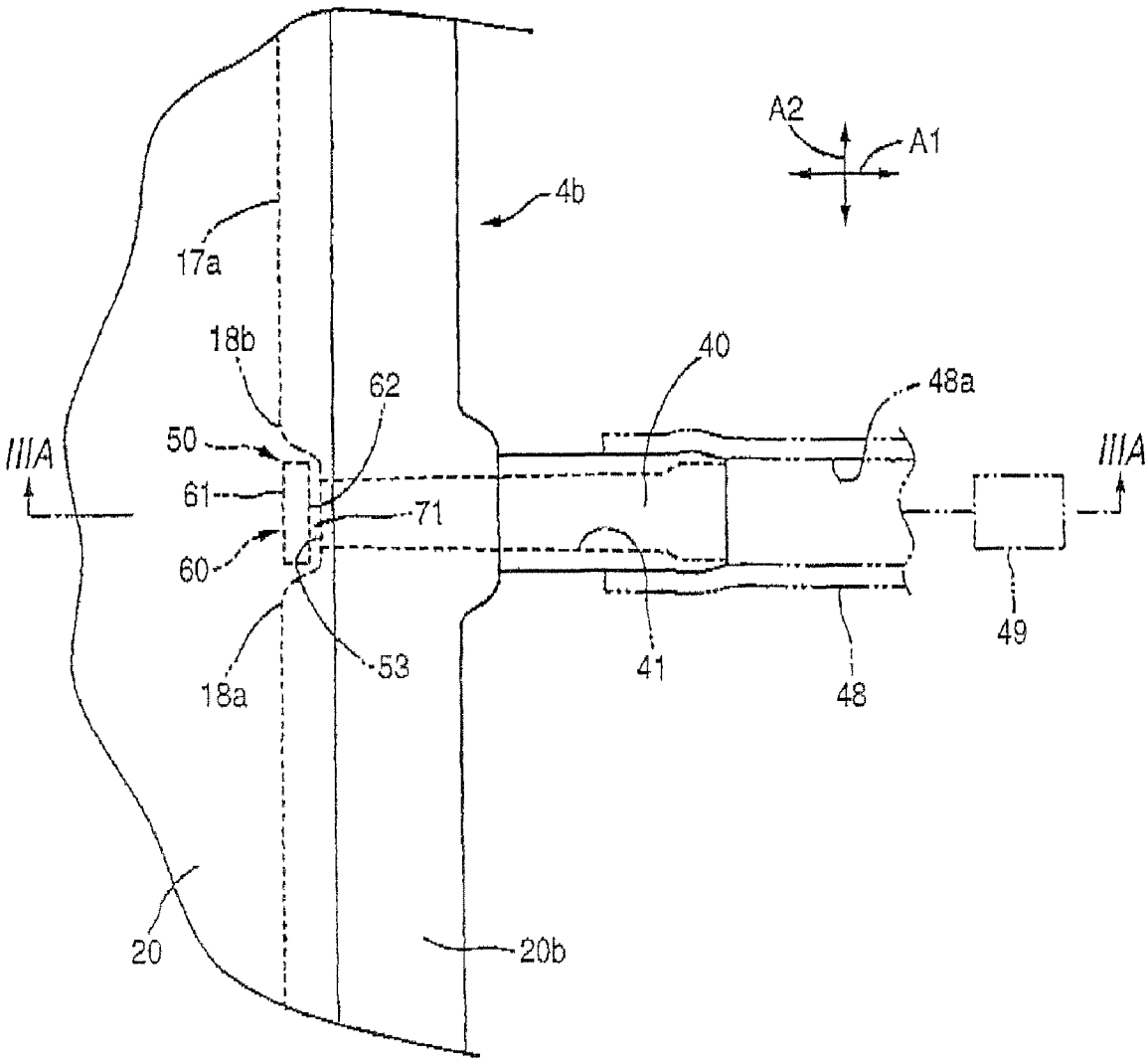
FIG. 2 is a view of a main part resulting when the intake manifold in FIG. 1A is seen from thereabove in a vertical direction.

Referring also to FIG. 1C, in the lower case 10 which forms, in cooperation with the upper case 20, the merged passage 32 which constitutes the intake passage lying further downstream than the throttle valve 3*a*, a negative pressure outlet portion 40, which forms a negative pressure passage 41 having a negative pressure outlet port 42 from which negative pressure generated in the merged passage 32 is take out, is provided on the side wall 17 of the lower case 10 so as to be molded integrally therewith.

A hole in a straight line which constitutes the negative pressure passage 41 is formed in the negative pressure outlet portion 40 having a pipe joint shape. A negative pressure conduit pipe 48 which forms a negative pressure passage 48*a* for guiding a negative pressure to a negative pressure utilization device 49 is connected to the hole.

The negative pressure utilization device 49, which is a device that operates by the negative pressure guided by both the negative pressure passages 41, 48*a* which are connected to each other, is, in this embodiment, a brake booster for increasing the brake effort exerted on a brake device, and the negative pressure conduit pipe 48 is connected to a negative pressure tank of the brake booster. In addition, the negative pressure utilization device 49 may be a negative pressure-type actuator other than the brake booster and furthermore it may be a negative pressure sensor.

Referring to FIGS. 1C, 2, 3A and 3B, the side wall 17 of the lower case 10 has a recessed portion 50 which is recessed towards an outer surface 17*b* side of the side wall 17 in a first horizontal direction A1 in part of the inner surface 17*a* which extends in the vertical direction A0. The recessed portion 50, which is molded integrally with the side wall 17 and is also molded integrally with the negative pressure outlet portion 40, forms a horizontal opening 51 which opens to the merged passage 32 in the horizontal direction A1 in a position which opposes to the negative pressure outlet port 42 and a deep surface 53, which will be described later, in the horizontal direction A1. The opening 51 is defined by a circumferential edge portion 18 which is part of the inner surface 17*a* to open to the inner surface 17*a*.

The recessed portion 50 has a recessed surface which is made up of the deep surface 53 and a depth surface 54. The deep surface 53 is positioned deep in the horizontal direction A1, extends in the horizontal direction A0 and the negative pressure outlet port 42 opens to the deep surface 53. The depth surface 54 extends from the deep surface 53 towards the opening 51 in a depth direction (one of which is the direction in which the recessed portion 50 is recessed relative to the circumferential edge portion 18) which is the horizontal direction A1 and continues to the circumferential edge portion 18. Accordingly, the recessed surface of the recessed portion 50 constitutes a surface which recedes from the circumferential edge portion 18 relative to the merged passage 32. In addition, in the merged passage 32, intake air flows across the opening 51 and along the circumferential edge portion 18 and the inner surface 17*a* which lies in the vicinity of the circumferential edge portion 18.

In addition, the depth surface 54 has a lower depth surface 54*a* which lies further downwards than the negative pressure outlet port 42. The lower depth surface 54*a* is inclined obliquely downwards to continue smoothly to an inner surface 15*a* of the bottom wall 15.

A vertical opening 52 is provided on the recessed portion 50 in a position which opposes to the mating surface 20*a* of the side wall 27 of the upper case 20 in the vertical direction A0 so as to open to the mating surface 10a and to open upwards. The opening 52 is provided so as to extend between the deep surface 53 and the opening 51 in the horizontal direction Al and continues to the opening 51.

The side wall 27 of the upper case 20 has a projecting portion 60, which extends downwards towards the negative pressure outlet port 42 and projects into the recessed portion 50 through the opening 52 in the vertical direction A0, in a position which aligns with the recessed portion 50 in the vertical direction A0 in such a state that both the cases 10, 20 are connected together (hereinafter, referred to as a "connected state"). The projecting portion 60 is molded integrally on the side wall 27 and extends from the mating surface 20*a* to projects further downwards than the mating surface 20*a*.

In the connected state, the projecting portion 60 is positioned such that entire thereof is positioned between the deep surface 53 or the negative pressure outlet port 42 and the circumferential edge portion 18 in the horizontal direction A1 and has a shape such that entire thereof is accommodated within the recessed portion 50. The projecting portion 60 has a front surface 61 and a rear surface 62. The front surface 61 faces the merged passage 32, continues smoothly to the inner surface 27*a* and extends in the vertical direction A0. The rear surface 62 opposes to the deep surface 53 in the horizontal direction A1. In addition, in a state that the projecting portion 60 is accommodated within the recessed portion 50, the projecting portion 60 covers part of the deep surface 53 from a merged passage 32 side, and the front face 61 is positioned on substantially the same plane as the circumferential edge portion 18 or occupies a position which recedes further than the circumferential edge portion 18. Therefore, the projecting portion 60 is situated in a position where the projecting portion 60 does not project from the circumferential edge portion 18 to the merged passage 32 side in the horizontal direction A1. Consequently, the projecting portion 60 does not project from the circumferential edge 18 to the merged passage 32.

A gap 71 is formed in the horizontal direction A1 between the rear surface 62 of the projecting portion 60 and the deep surface 53. A width w1 of the gap 71 in the horizontal direction A1, a thickness w2 of the projecting portion 60 in the horizontal direction A1 and a distance w3 between the deep surface 53 and the front surface 61 in the horizontal direction are, even at their maximums, smaller than a width w7 of the negative pressure outlet port 42, which will be described later, or maximum width w8 of the negative pressure outlet port 42 in the vertical direction (in this state, a diameter of the negative pressure outlet port 42). In this embodiment, the thickness w1, w2 and w3 are equal to or less than one half of the widths w7, w8. According to these dimensional relations, the depth of the recessed portion 50 in the horizontal direction A1 can be reduced, whereby the recessed portion 50 can be made smaller in size in the horizontal direction A1.

In this embodiment, the protecting portion 60 has a flat plate-like shape when viewed from a front direction (hereinafter, referred to as "as viewed from the front"), the thickness w2 in the depth direction (also the horizontal direction A1) is smaller than width w6 in second horizontal direction A2 and length w5 in the vertical direction A0 and has substantially quadrangular shape as viewed from the front.

Here, the "front direction" means a direction which is substantially perpendicular to the opening 51 on a horizontal plane or the circumferential edge portions 18*a*, 18*b* holding the opening 51 in the horizontal direction A2 and also a direction in which the recessed portion 50 and the projecting portion 60 are viewed from the merged passage 32 side. A front direction A3 is exemplified in FIGS. 1C and 3A.

In addition, the front direction A3 is parallel to center axis L of the straight-line negative pressure passage 41 and the horizontal direction A1 and also perpendicular to the negative pressure outlet port 42. In addition, as viewed from the vertical direction A0, the horizontal direction A1 is perpendicular to the horizontal direction A2.

As viewed from the front, the width w7 of the negative pressure outlet port 42 (in this embodiment, the diameter of the negative pressure outlet port 42) which is measured between end portions 44, 45 of the negative pressure outlet port 42 in the horizontal direction A2 is smaller than the width w6 of the projecting portion 60. The projecting portion 60 is disposed within the range of the negative pressure outlet port 42 in the horizontal direction A2.

Furthermore, widths w11, w12 of respective gaps 72, 73 between the circumferential edge portion 18 and the projecting portion 60 in the horizontal direction A2 are, even at their maximums, smaller than the width w6 of the projecting portion 60 and the width w7 of the negative pressure outlet port 42.

In addition, in order to suppress the increase in passage resistance in the merged passage 32 by the recessed portion 50, the respective widths w11, w12 are preferably smaller.

A lower end portion 63 of the projecting portion 60 is positioned above the negative pressure outlet port 42 which exhibits a circular shape as viewed from the front. In this embodiment, the lower end portion 63 is positioned above the vicinity of the negative pressure outlet port 42. Here, "above the vicinity of the negative pressure outlet port 42" means that a space in the vertical direction between an uppermost portion 64 of the lower end portion 63 and an uppermost portion 43 of the negative pressure outlet port 42 is zero or 10% or less of the length w5 in the vertical direction A0 of the projection portion 60.

Therefore, the projecting portion 60 is not positioned further downwards than the negative pressure outlet port 42 in the vertical direction A0. Because of this, the projecting portion 60 covers the recessed portion 50 and the deep surface 53 in the vertical direction A0 in such a range in the vertical direction A0 from the opening 52 or the respective mating surfaces 10*a*, 20*a* to above the vicinity of the negative pressure outlet port 42. Consequently, the negative pressure outlet port 42 is not covered by the projecting portion 60 and is hence exposed to the intake passage (the merged passage 32).

In addition, as viewed from the vertical direction A0, the negative pressure outlet port 42 lies in a position which recedes further towards the outer surface 17*b* side (that is, towards an opposite side to the merged passage 32 or the circumferential edge portion 18) than the entirety of the projecting portion 60 in the horizontal direction A1.

The lower end portion 63 extends, as viewed from the front, in a straight line substantially parallel to the horizontal direction A2, and a central portion 65 in the horizontal direction A2 of the lower end portion 63 lies substantially in the same position in the vertical direction A0 as the uppermost portion 43 of the negative pressure outlet port 42 (which is also an upper most portion of an upper contour 46*a* of the negative pressure outlet port 42) which lies in a central portion thereof in the horizontal direction A2. Therefore, in this embodiment, the uppermost portion 43 also constitutes a lowermost portion of the lower end portion 63. In addition, as viewed from the front, the projecting portion 60 is symmetry relative to a straight line which passes through the center axis L and which is parallel to the vertical direction A0.

Here, the upper contour 46*a* means a portion of a contour 46 of the negative pressure outlet port 42 which is positioned further upwards than both the end portions 44, 45 which specify the width w7, and in this embodiment, a semi-circular or a arc-shaped portion which is positioned further upwards than both the end portions 44, 45 which lie on a straight line which passes through the center axis L and which is parallel to the horizontal direction A2, or a contour of an upper half portion when the negative pressure outlet port 42 is bisected in the vertical direction A0.

The negative pressure outlet port 42 is not covered by the projecting portion 60 which lies above the negative pressure outlet port 42 in the horizontal direction A1 with respect to the merged passage 32, and the negative pressure outlet port 42 opens towards the merged passage 32 so as not to be hindered in no case by the projecting portion 60 in the front direction or the horizontal direction A1. By this configuration, since an airflow which flows out from the negative pressure outlet port 42 towards the merged passage 32 is not hindered by the projecting portion 60, the efficiency of taking out the negative pressure in the merged passage 32 can be increased.

In addition, in the upper case 20, since there may occur a situation in which the projecting portion 60 is damaged when handling the upper case 20, depending upon locations where the projecting portion 60 is provided, it is desirable to avoid such damage. Then, both corner portions 66, 67 in the horizontal direction A2 of the lower end portion 63 are chamfered into a radius shape and hence are rounded, whereby damage such as chipping is prevented from being caused on the respective corner portions 66, 67 when handling the upper case 20.

There may be a situation where moisture which is present in air which flows in the intake passage adheres to the inner surfaces of the lower case 10 and the upper case 20 in the form of water drops when the internal combustion engine is driven.

At driving or stopping of the internal combustion engine, water drops, which are adhered to the inner surface 27*a* of the side wall 27 of the upper case 20 and flow down the inner surface 27*a* along towards the negative pressure outlet port 42, fall downwards from the lower end portion 63 of the projecting portion 60 along the front surface 61 of the projecting portion 60, adhere to the lower depth surface 54*a* which is inclined downwards towards the bottom wall 15 and flow down along the lower depth surface 54*a* to flow out to the bottom wall 15 smoothly. Accordingly, water is prevented from remaining on the lower depth surface 54*a*.

When water drops fall from the projecting portion 60 while being guided by the projecting portion 60, since the negative pressure outlet port 42 lies in the position which recedes further backwards towards a deep surface 53 side of the recessed portion 50 than the lower end portion 63 in the horizontal direction A1, the water drops falling from the lower end portion 63 are made difficult to enter into the negative pressure outlet port 42. Therefore, the water drops are restrained or prevented from entering into the negative pressure passage 41 from the negative pressure outlet port 42. Thus, the waterproof construction for preventing or suppressing the entering of water drops into the negative pressure outlet port 42 is made up of the recessed portion 50 and the projecting portion 60.

Next, the functions and advantages of the above described embodiment will be described.

The recessed portion 50, which is recessed in the horizontal direction A1, is provided on part of the inner surface 17*a* of the side wall 17 of the lower case 10. The recessed portion has, in its deep portion, the deep surface 53 to which the negative pressure outlet port 42 opens, and the opening 51 opened upwards is provided in the upper portion of the recessed portion 50 in the position which opposes to the upper case 20 in the vertical direction A0. The upper case 20 has the projecting portion 60 which extends further downward towards the negative pressure outlet port 42 than the mating surfaces 10*a*, 20*a* and projects into the recessed portion 50 through the opening 52, and the projecting portion 60 is positioned between the negative pressure outlet port 42 and the inner surface 17 in the horizontal direction A1 and does not cover the negative pressure outlet port 42 in the horizontal direction A1.

Accordingly, the water drops, which flow down towards the negative pressure outlet port 42 along the inner surface 27*a* of the side wall 27, flow down along the projecting portion 60 which lies closer to the merged passage 32 side than the negative pressure outlet port 42 to fall downwards from the lower end portion 63 of the projecting portion 60. Therefore, the entering of water drops into the negative pressure outlet port 42 which lies deeper than the projecting portion 60 in the recessed portion 50 is suppressed. Accordingly, the reduction in performance of the function of taking out the negative pressure, which would otherwise be caused by water drops which have entered from the negative pressure outlet port 42 and become frozen, can be prevented.

Further, since the projecting portion 60 is accommodated within the recessed portion 50 and hence does not project from the inner surface 17*a* into the merged passage 32, the increase in passage resistance in the merged passage 32 by the waterproof construction made up of the recessed portion 50 and the projecting portion 60 is suppressed, and the intake efficiency is increased by such an extent that the increase in passage resistance is so suppressed.

Furthermore, the waterproof construction is configured by connecting to each other the lower case 10, which has the recessed portion 50 on which the negative pressure outlet port 42 and the opening 52 opened upwards are provided, and the upper case 20, which has the projecting portion 60 extending downwards, while accommodating the projecting portion 60 so as to project from the opening 52 into the recessed portion 52. Therefore, since the lower case 10 and the upper case 20 which have the recessed portion 50 and the projecting portion 60, respectively, are separate members, the respective constructions of the recessed portion 50 and the projecting portion 60 are simplified. Further, their easiness of molding process is increased including a case where the recessed portion 50 and the projecting portion 60 are molded integrally on the lower case 10 and the upper case 20, respectively. Therefore, the production costs of the intake device 1 can be reduced.

The projecting portion 60 which is situated within the recessed portion 50 is positioned between the inner surface 17*a* and the negative pressure outlet port 42 in the horizontal direction A1 which is also the direction in which the recessed portion 50 is recessed relative to the inner surface of the lower case 10. Therefore, the projecting portion 60 is not required to surround the negative pressure outlet port 42. Accordingly, the recessed portion 50 is made smaller in size, which increases the degree of freedom in disposing the negative pressure outlet port 42, and the lower case 10 can be made smaller in size and lighter in weight. Since the negative pressure outlet port 42 opens to the deep surface 53, compared with a case where the negative pressure outlet port 42 opens to the depth surface 54 of the recessed portion 50, the recessed portion 50 can be made small in size in the horizontal direction A1.

In addition, the projecting portion 60 is positioned above the negative pressure outlet port 42 and is not positioned further downwards than the negative pressure outlet port 42. Thus, the projecting portion 60 does not cover the negative pressure outlet port 42 in the horizontal direction A1 which is also the direction in which the recessed portion 50 is recessed relative to the inner surface 17*a*. Therefore, even if the projecting portion 60 and the negative pressure outlet port 42 are positioned close to each other in the horizontal direction A1, a negative pressure is not prevented from being take out of the negative pressure outlet port 42 by the projecting portion 60. Thus, the negative pressure taking out function can be ensured while making the waterproof construction small in size in the horizontal direction A1.

The recessed surface of the recessed portion 50 has the deep surface 53 which opposes to the projecting portion 60 in the horizontal direction A1, and the negative pressure outlet port 42 opens to the deep surface 53. By the gap 71 being provided between the deep surface 53 and the projecting portion 60 in the horizontal direction, water drops falling along the projecting portion 60 are prevented from continuing to fall from the lower end portion 63 of the projecting portion 60 to the deep surface 53 opened to the negative pressure outlet port 42 by the gap 71 provided between the projecting portion 60 and the deep surface 53 in the horizontal direction A1. Consequently, the entering of water drops into the negative pressure outlet port 42 can be suppressed further. Thus, the effect of preventing the entering of water drops into the negative pressure outlet port 42 by the waterproof construction is improved.

The lower end portion 63 of the projecting portion 60 is positioned above the vicinity of the negative pressure outlet port 42 and has the shape which matches the upper contour 46*a* of the negative pressure outlet port 42, the projecting portion 60 which is situated within the recessed portion 50 extends as far as above the vicinity of the negative pressure outlet port 42 to cover the recessed portion 50, and a range over which the recessed portion 50 is covered by the projecting portion 60 above the negative pressure outlet port 42 is increased. Therefore, a turbulent flow of intake air caused by the recessed portion 50 is suppressed. Thus, the increase in passage resistance in the intake passage is suppressed further. Moreover, the adhesion of water drops to the recessed surface including the deep surface 53 above the negative pressure outlet port 42 is suppressed further, thereby increasing the effect of preventing the entering of water drops into the negative pressure outlet port 42.

Next, referring to FIGS. 4 and 5, second and third embodiments of the invention will be described. The second and third embodiments differ from the first embodiment in the shape of a projecting portion 60 and have basically the same configuration as that of the first embodiment with respect to the remaining features. Because of this, the description of like portions will be omitted or simplified, while the description of different features will mainly be made. Note that like reference numerals will be given to like members or corresponding members to those of the first embodiment.

Figure 4:
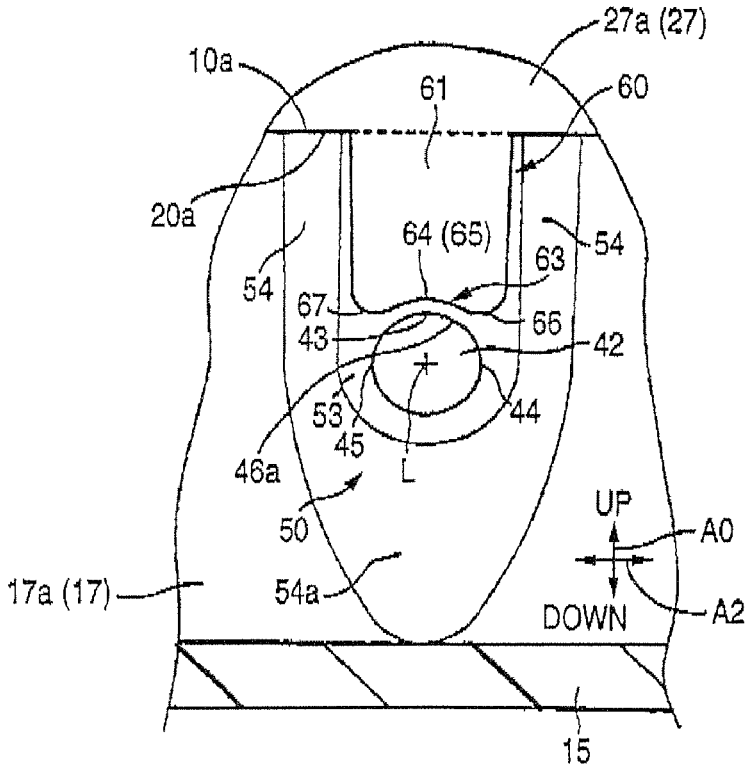
FIG. 4 is a view corresponding to FIG. 3B, which shows a second embodiment of the invention

Referring to FIG. 4, in a second embodiment, a projecting portion 60 is symmetrical with respect to a straight line which passes through a center axis L and which is parallel to a vertical direction A0 as viewed from the front. In addition, the vicinity of a central portion 65 of a lower end portion 63 of the projecting portion 60 is an intermediate portion which is held between both corner portions 66, 67 in a horizontal direction A2 and is positioned substantially within a range defined between both end portions 44, 45 of a negative pressure outlet port 42 in the horizontal direction A2. The vicinity of the central portion 65 has a shape which matches an upper portion of an arc-shaped upper contour 46*a* of the negative pressure outlet port 42 and hence a shape which is substantially similar to the upper contour 46*a*, resulting in an arc-like shape in which the central portion 65 is recessed upwards. In addition, the vicinity of the central portion 65 including an uppermost portion 64 is positioned in its entirety above the vicinity of the negative pressure outlet port 42.

In addition, the respective corner portions 66, 67 in the horizontal direction A1 of the lower end portion 63 project further downwards than an uppermost portion 43 of the negative pressure outlet port 42 and constitute lowermost portions of the lower end portion 63. Respective distal end portions of the corner portions 66, 67 are chamfered into an arc shape and are situated substantially in the same position as the uppermost portion 43 of the negative pressure outlet port 42 in the vertical direction A0.

According to the second embodiment, in addition to the same function and advantage as those provided by the first embodiment, the following function and advantage are provided.

In water drops which fall along a front surface 61 of the projecting portion 60, since water drops lying in the vicinity of the uppermost portion 64 are made easy to move to the respective corner portions 66, 67 to fall from the respective corner portions 66, 67 and along both the end portions 44, 45, water drops are made more difficult to enter into the negative pressure outlet port 42.

Figure 5:
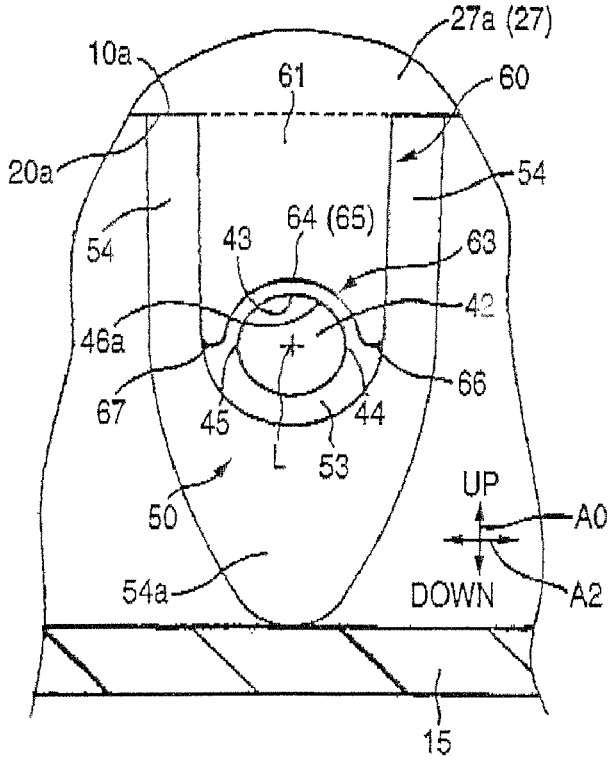
FIG. 5 is a view corresponding to FIG. 3B, which shows a third embodiment of the invention.

Referring to FIG. 5, in a third embodiment in which a projecting portion 60 has the same shape as that of the second embodiment, when compared with the corner portions 66, 67 of the second embodiment, respective corner portions 66, 67 of a lower end portion 63 of a projecting portion 60 extend downwards to substantially the same position as respective end portions 44, 45 of a negative pressure outlet port 42 in a vertical direction A0. Because of this, the vicinity of a central portion 65 of a lower end portion 63 of the projecting portion 60 which is an intermediate portion held between the corner portions 66, 67 in a horizontal direction A2 is positioned over a range which is wider than a range defined between both the end portions 44, 45 and has a shape which matches an upper contour 46*a* over the whole of the upper contour 46*a* and hence a shape which is substantially similar to the upper contour 46*a*. In addition, the vicinity of the central portion 65 including an uppermost portion 64 is positioned in its entirety above and in the vicinity of the negative pressure outlet port 42.

According to the third embodiment, in addition to the same function and advantage as those provided by the first embodiment, the following function and advantage are provided.

Since water drops falling from the respective corner portions 66, 67 are guided so as to fall in positions which are apart from the negative pressure outlet port 42 in the horizontal direction A2, the function and advantage of the second embodiment are enhanced further. In addition, compared with the first and second embodiments, since a range over which the recessed portion 50 is covered by the projecting portion 60 in the horizontal direction A3 is expanded, the adhesion of water drops to a deep surface 53 which makes up a recessed surface of a recessed portion 50 (refer to FIG. 3A) and a depth surface 54 is suppressed further, whereby the entering of water drops into the negative pressure outlet port 42 is suppressed further.

Next, modifications to the above-described exemplary embodiments will be described. In the following embodiments, the configurations of the above-described embodiments are partially modified.

In an intake device 1, passage components other than an intake manifold 4 which makes up an intake passage may be made up of a plurality of passage walls which include at least a lower passage wall and an upper passage wall, and a recessed portion, a projecting portion and a negative pressure outlet portion 42 may be provided in the passage components A recessed portion 50 or a projecting portion 60 may be a separate member from a side wall 17 of a lower case 10 or a side wall 27 of an upper case 20 and may be made up of a passage wall which is may be attached and/or detached to the side walls 17, 27. In addition, a negative pressure outlet portion 40 may be a separate member from the recessed portion 50.

A gap 71 may be formed in such a state that a rear surface 62 of a projecting portion 60 and a deep surface 53 are in contact with each other via a projecting portion which is provided on the rear surface 62 or the deep surface 53. Furthermore, the rear surface 62 and the deep surface 53 may be in surface contact with each other over substantially the whole area thereof.

Figure 3A:
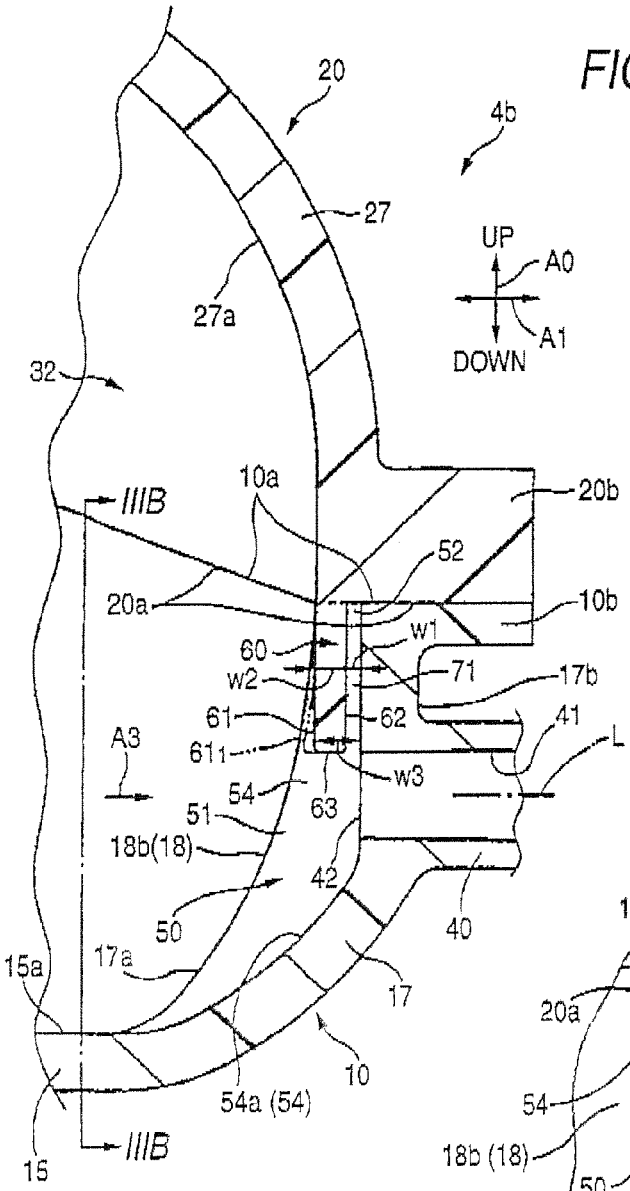
FIG. 3A is a sectional view taken along the line III-IIIA in FIG. 2.
Figure 3B:
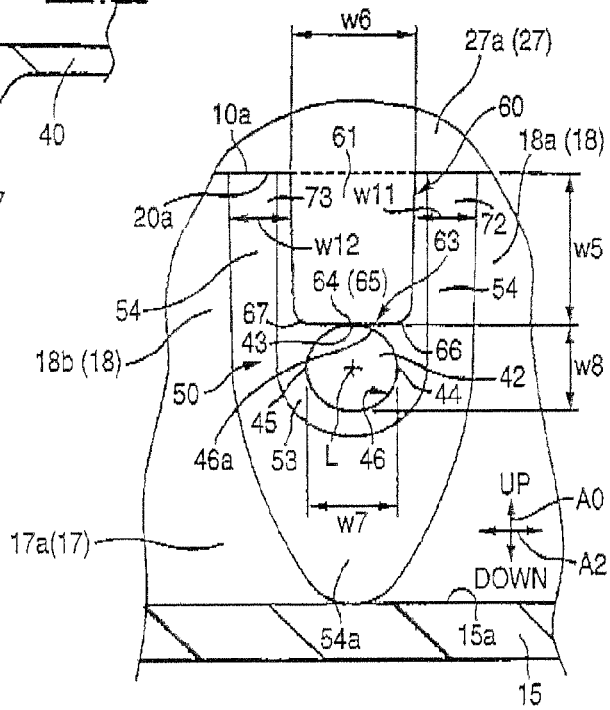
FIG. 3B is a sectional view taken along the line IIIB-IIIB in FIG. 3A.

A front surface $\mathbf{61}_1$ of a projecting portion 60 may be formed to match the shape of a circumferential edge portion 18 as indicated by a double-dashed chain line in FIG. 3A so as to be positioned substantially on the same plane as the circumferential edge portion 18 (note that for the purpose of illustration, in FIG. 3B the front surface $\mathbf{61}_1$ is depicted in a position spaced apart from the circumferential edge portion 18), whereby the passage resistance in the intake passage is reduced further. Furthermore, by the front surface $\mathbf{61}_1$ being formed into a shape in which the front surface $\mathbf{61}_1$ is gradually spaced apart from a negative pressure outlet port 42 towards an intake passage side as it extends downwards, the entering of water drops falling from the projecting portion 60 into the negative pressure outlet port 42 is suppressed further.

The shape of the negative pressure outlet port 42 may take other shapes than the circular shape. In the embodiments, while the negative pressure outlet port 42 opens only to the deep surface 5, the negative pressure outlet port 42 may also open to a range between the deep surface 53 and the depth surface 54 or only to the depth surface 54.

Further, it is adaptable that the throttle device 3 is a carburetor.

Furthermore, the intake manifold 4 which is other than the merged portion 4*b* such as the branch portion 4*c* or the passage components which makes up the intake device 1 (for example, the throttle body 3*b* of the throttle device 3) may include an upper passage wall having a recessed portion 50 and an upper passage wall having a projecting portion 60.

The internal combustion engine may be a compression ignition type internal combustion engine or an internal combustion engine that is used for a marine propulsion system such as a marine outboard engine which includes a crankshaft directed in a vertical direction A0.

While the invention has been described in connection with the exemplary embodiments, it will be obvious to those skilled in the art that various changes and modifications may be made therein without departing from the present invention, and it is aimed, therefore, to cover in the appended claim all such changes and modifications as fall within the true spirit and scope of the present invention.

What is claimed is:

1. An intake device of an internal combustion engine, comprising:

an upper case having an upper side wall and a ceiling wall, and a lower case having a lower side wall and a bottom wall, the lower case and the upper case being connected together to form an intake passage with a lower portion of the upper side wall disposed next to an upper portion of the lower side wall in a vertical direction, wherein the lower side wall has a recessed portion formed on an inner surface thereof, the recessed portion defining a recessed surface extending from the upper portion of the lower side wall toward the bottom wall, wherein a negative pressure outlet port for taking out negative pressure generated in the intake passage opens into the recessed portion, and wherein the upper side wall has a projecting portion which projects downwards from the lower portion of the upper side wall into the recessed portion towards the negative pressure outlet port, the projecting portion being positioned horizontally between the negative pressure outlet port and the inner surface.

2. The intake device of the internal combustion engine as set forth in claim 1, wherein the recessed surface defines a deep portion having a deep surface horizontally opposed to the projecting portion, the negative pressure outlet port opens at the deep surface, and a gap is provided in a horizontal direction between the deep surface and the projecting portion.

3. The intake device of the internal combustion engine as set forth in claim 1, wherein a lower end portion of the projecting portion is situated above the vicinity of the negative pressure outlet port and has a shape following an upper contour of the negative pressure outlet port.

* * * * *